United States Patent [19]

Henthorn, Jr.

[11] 3,945,642

[45] Mar. 23, 1976

[54] ARROW

[76] Inventor: Warren D. Henthorn, Jr., P.O. Box 151, Howard, Ohio 43028

[22] Filed: Nov. 13, 1974

[21] Appl. No.: 523,532

[52] U.S. Cl. ..... 273/106.5 R; 43/6; 273/106.5 B

[51] Int. Cl.[2] ..... F41B 5/02

[58] Field of Search ..... 273/106.5 B, 106.5 R, 101; 43/6

[56] References Cited

UNITED STATES PATENTS

| | | | |
|---|---|---|---|
| 1,423,551 | 7/1922 | Adriance | 273/106.5 B |
| 2,905,470 | 9/1959 | Hoyt, Jr. | 273/106.5 B |
| 3,153,875 | 10/1964 | Califano | 43/6 |
| 3,164,385 | 1/1965 | Shure | 273/106.5 B |
| 3,405,941 | 10/1968 | Martell et al. | 273/101 |

*Primary Examiner*—Paul E. Shapiro
*Attorney, Agent, or Firm*—Clarence A. O'Brien; Harvey B. Jacobson

[57] ABSTRACT

An arrowhead assembly having a shank connectible to a shaft of an arrow and to an arrowhead tip. A substantially rigid shield is slidably mounted on the shank and biased toward the tip as by a coiled spring for retarding motion of the arrow on the arrow entering an animal or other target. When the assembly includes tips such as a fish point having diverging barbs extending from the point at the tip an adapter unit is advantageously employed to space the tip from the shank.

9 Claims, 10 Drawing Figures

Fig. 1
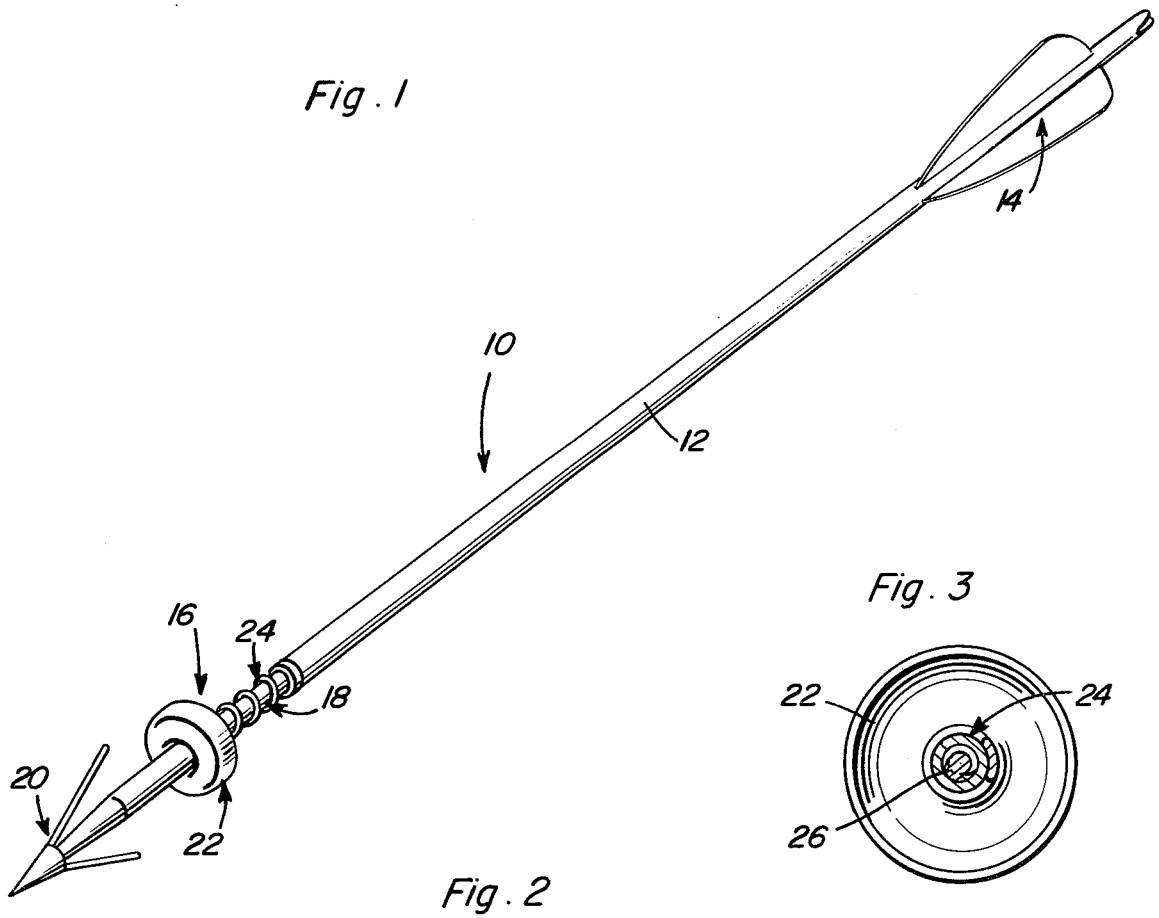
Fig. 3
Fig. 2
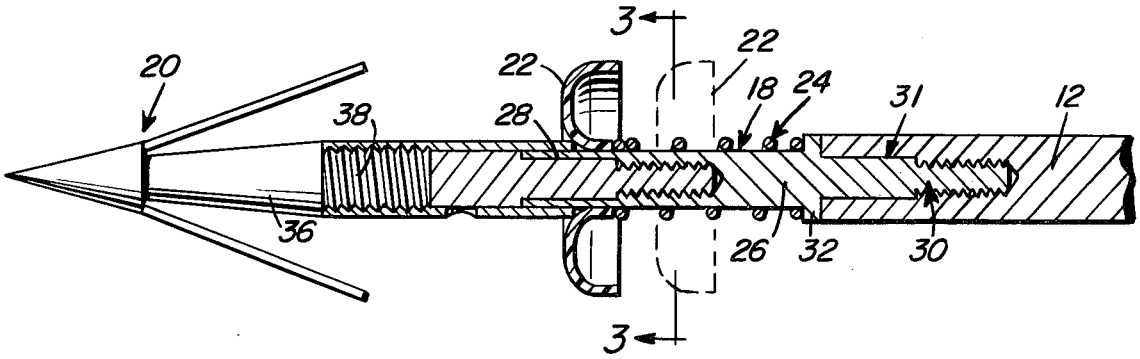
Fig. 4
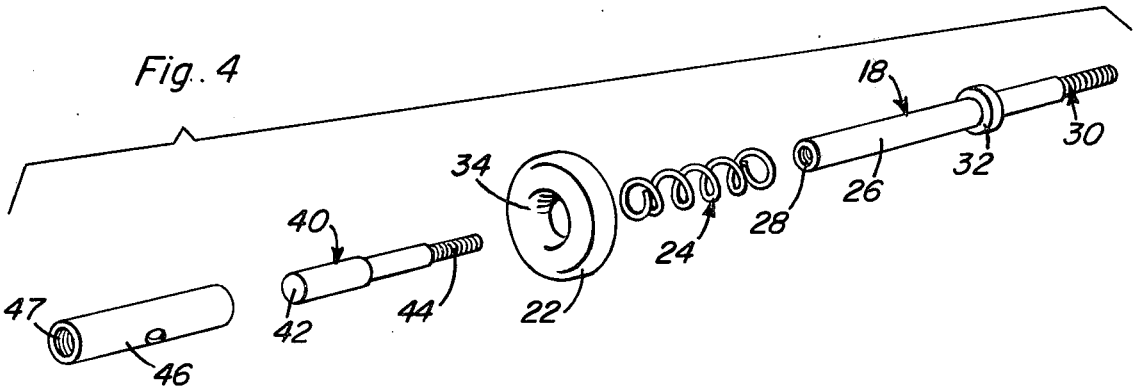

ARROW

BACKGROUND OF THE INVENTION

1. Field of the Invention

This invention relates generally to arrows, and particularly to an arrowhead assembly for use in hunting animals, fish, and reptiles, that will inflict much greater damage more quickly to the animal, and the like, and result in a more humane kill.

2. Description of the Prior Art

A problem encountered in hunting small game with bow and arrows is that the animal frequently escapes after being wounded by an arrow because the arrow either completely penetrates the game or fails to achieve penetration sufficient for a kill. To solve this problem, it has been proposed to provide arrowheads which will tend to prevent complete penetration of the arrow through the game, while simultaneously transferring substantially all of the energy of the arrow to the target. Although blunt-end arrowheads are commonly used in order to achieve a high rate of transfer of energy from the arrow to the target, it is also important that sufficient penetration be achieved by the arrowhead even at relatively low arrow velocities.

U.S. Pat. No. 2,905,470, issued Sept. 22, 1959 to E. H. Hoyt, Jr., discloses a pointed arrowhead having a flat circular head adjacent the pointed tip of the arrowhead for preventing the arrow from passing completely through small game and the like. This circular head is rigidly mounted on the arrowhead, and effectively forms an integral part thereof arranged immediately adjacent the point of the arrowhead.

Other prior patents believed pertinent to this application are as follows:

| | | |
|---|---|---|
| 2,568,417 | B. H. Steinbacher | Sept. 18, 1951 |
| 3,036,396 | R. Swails | May 29, 1962 |
| 3,164,385 | R. L. Shure | Jan. 5, 1965 |

SUMMARY OF THE INVENTION

It is an object of the present invention to provide an arrowhead assembly that permits sufficient penetration of an arrowhead, while simultaneously preventing the arrowhead from completely penetrating the target.

It is another object of the present invention to provide an arrowhead assembly which inflicts much greater damage more quickly to an animal an results in a more humane kill.

It is still another object of the present invention to provide an arrowhead assembly capable of slowing an arrow in flight, and preventing the arrow from traveling over a predetermined distance.

It is yet another object of the present invention to provide an arrowhead assembly that prevents the loss of game under water once a fish or frog has been impaled on the point of the arrowhead assembly.

These and other objects are achieved according to the present invention by providing an arrowhead assembly having: a shank connectible to a shaft of an arrow and to an arrowhead tip; a substantially rigid shield slidably mounted on the shank; and resilient means arranged on the shank and abutting the shield for biasing the shield toward the tip and permitting penetration of the tip into a target while the shield retards motion of the arrow.

According to a preferred embodiment of the present invention, the shank is a cylinder having a pair of spaced ends, with a threaded counter-bored socket provided at one end and a threaded, shouldered projection provided at the other end, the socket being arranged for receiving the tip and the projection being arranged for being inserted into an arrow shaft. Further, the shank is advantageously provided with a flange adjacent the projection. The resilient means may be a conventional coiled spring arranged on the shank between the flange and the shield.

A preferred shield according to the present invention is in the form of an annular cup forming an opening arranged for receiving the shank.

When the tip is a fish point, and the like, it is advantageous to employ an adapter according to the invention to space the tip from the shank, so that the barbs of the tip will clear the shield.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of an arrow provided with an arrowhead assembly according to the present invention and including a fish point tip.

FIG. 2 is a fragmentary, longitudinal sectional view showing in detail the arrowhead assembly illustrated in FIG. 1.

FIG. 3 is a sectional view taken generally along the line 3—3 of FIG. 2, but with the arrowhead tip removed.

FIG. 4 is an exploded, perspective view showing the arrowhead assembly of FIGS. 1 through 3, but with the arrowhead tip removed.

DESCRIPTION OF THE PREFERRED EMBODIMENTS

Figure 5:
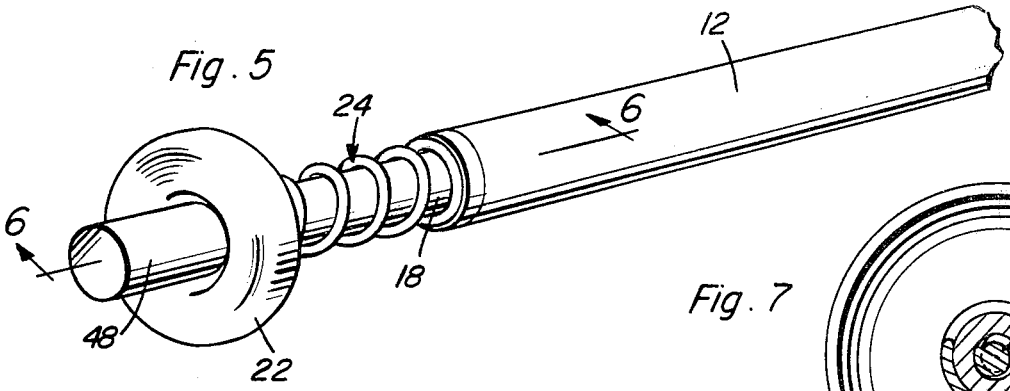
FIG. 5 is a fragmentary, perspective view showing an arrowhead assembly according to the present invention and including a blunt tip.

FIG. 1 of the drawings shows an arrow 10 having a shaft 12 provided in a conventional manner with feathers 14 and having arranged at the end thereof spaced from feathers 14 an arrowhead assembly 16 according to the present invention. This assembly 16 includes a shank 18 connected to shaft 12 and to an arrowhead tip 20. A substantially rigid shield 22 is slidably mounted on shank 18, and is biased toward tip 20 as by a conventional coiled spring 24 having the coils thereof arranged around shank 18. As will become clearer below, shank 18 is mounted on shaft 12 by use of the threaded socket conventionally provided in the shafts of commercially available arrows, such as those manufactured by the Bear Company, for removably attaching the arrowhead tip to the arrow shaft.

Referring now more particularly to FIGS. 2 through 4 of the drawings, shank 18 includes a cylinder 26 having a pair of spaced ends, with a threaded counter-bored socket 28 provided at one end and a threaded, shouldered projection 30 provided at the other end. Socket 28 is arranged for receiving a threaded extension of a tip 20, while projection 30 is arranged for being inserted into the aforementioned socket provided in an arrow shaft 12. The latter mentioned socket is designated 31 in FIG. 2 of the drawings. Shank 18 is also provided with an abutment flange 32 arranged adjacent projection 30 for providing an abutment for one end of spring 24. As can be readily appreciated from, for example, FIG. 2, the other end of spring 24 abuts shield 22. The latter is advantageously in the form of an annular cup forming an opening 34 arranged for receiving cylinder 26 of shank 18 in such a manner that shield 22 is slidable along the extent of cylinder 26.

Although shield 22 is illustrated as having the rounded portion thereof facing tip 20, it is to be understood that shield 22 could be arranged on shank 18 in the reverse orientation if so desired. When reversed from the illustrated orientation, shield 22 will act to slow the flight of the arrow in air, much in the manner of the well-known flu-flu arrow, and will limit the arrow from traveling more than a predetermined distance, such as, for example, 70 yards.

It is also to be understood that shield 22 may be somewhat flexible in construction, and may take other configurations than that illustrated in the accompanying drawings.

The particular embodiment of assembly 16 shown in FIGS. 2 through 4 of the drawings is provided with a tip 20 in the form of a conventional fish point tip provided with a plurality of barbs. Tip 20 is also provided with a base portion 36 that diverges, or flares, toward an end that terminates in a threaded rod 38. When using a tip such as that designated 20, it is necessary to use an adapter 40 in order to space the tip 20 sufficiently from shield 22 so as to assure proper clearance between the barbs of the tip and the shield.

A preferred adapter 40 according to the present invention is provided with a blunt end 42, and an end spaced longitudinally from end 42 and terminating in a threaded, shouldered extension 44 engageable with socket 28 of shank 18. A sleeve 46 is arranged over adapter 40 and is provided with a threaded socket 47 arranged for engaging the threaded rod 38 which is conventionally provided on a tip 20. Sleeve 46, which is advantageously bonded to adapter 40 by a suitable adhesive, abuts base portion 36 of tip 20 and shield 22 for providing a limit stop for shield 22 in the direction of tip 20. End 42 of adapter 40 is contacted by the end of threaded rod 38.

Figure 7:
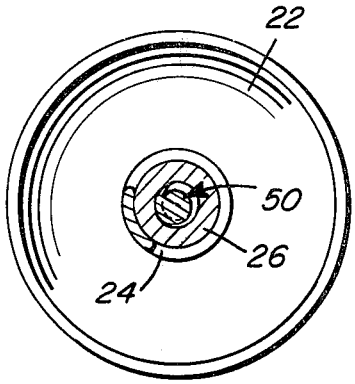
FIG. 7 is a sectional view taken generally along the line 7—7 of FIG. 6.
Figure 6:
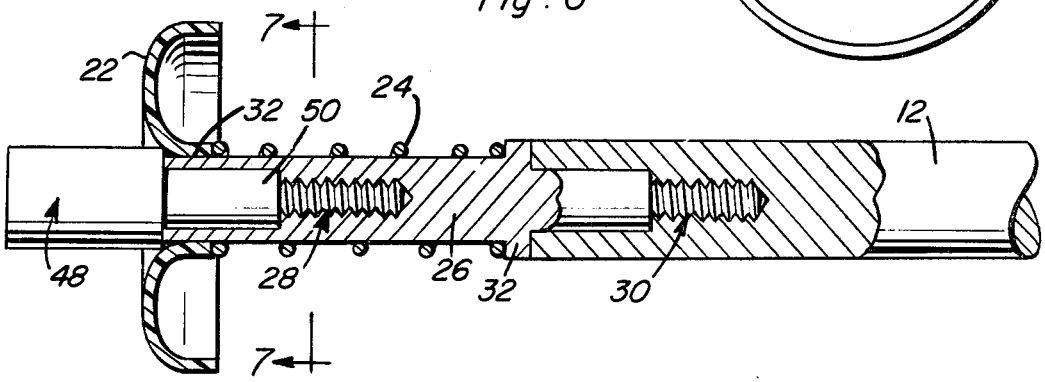
FIG. 6 is a fragmentary, sectional view taken generally along the line 6—6 of FIG. 5.

Referring now to FIGS. 5 through 7 of the drawings, it is also possible to employ a conventional blunt tip 48 with an arrowhead assembly according to the present invention. As can be clearly seen from FIGS. 6 and 7, this conventional tip 48, which is however in the present instance made slightly smaller than those blunt tips commercially available and is constructed from a lightweight material such as aluminum, is conventionally provided with an extension 50 engageable with the threaded socket 28 of shank 18. Otherwise, the arrangement of elements in the embodiment shown in FIGS. 5 through 7 of the drawings may be identical to the corresponding elements of the embodiment shown in FIGS. 1 through 4 of the drawings.

Figure 8:
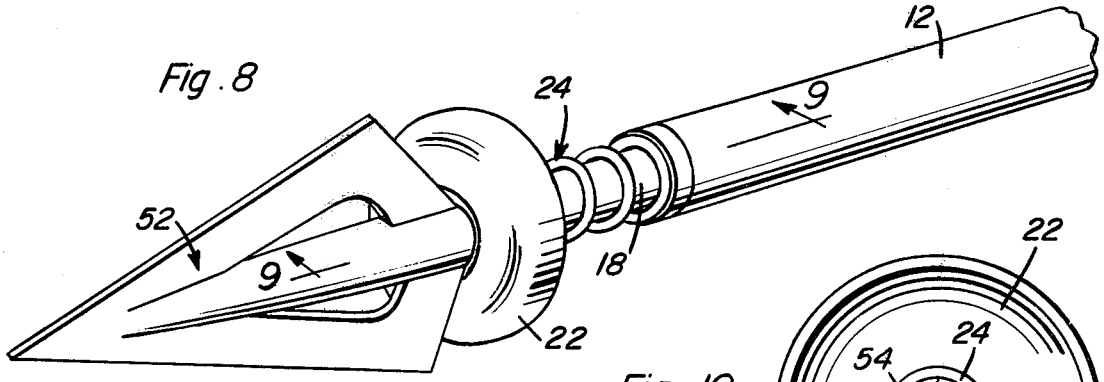
FIG. 8 is a fragmentary, perspective view similar to FIG. 5, but showing an arrowhead assembly according to the invention which includes a broad-head tip.
Figure 10:
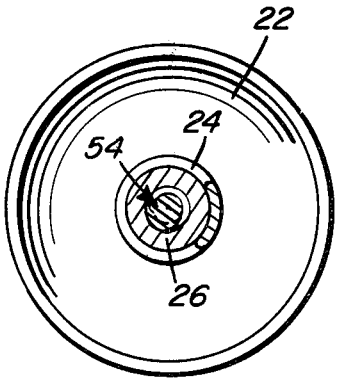
FIG. 10 is a sectional view taken generally along the line 10—10 of FIG. 9, but with the arrowhead tip removed.
Figure 9:
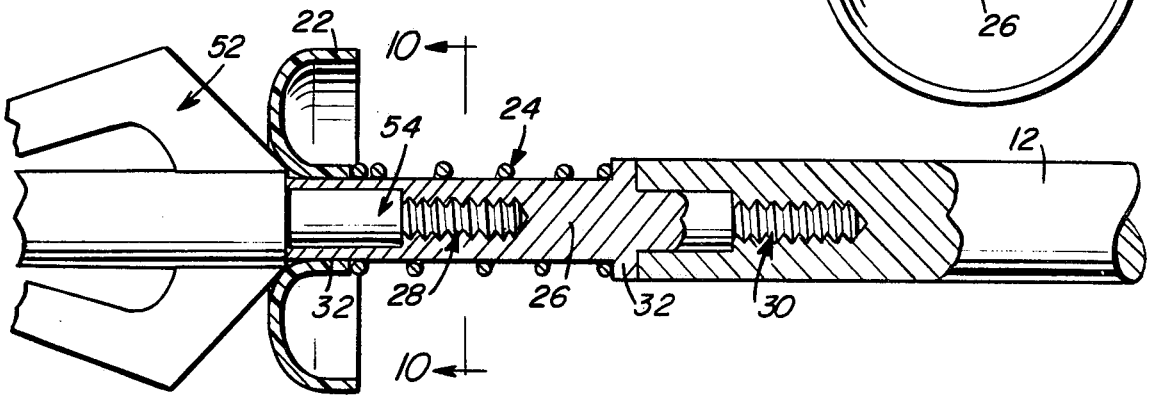
FIG. 9 is a fragmentary, sectional view taken generally along the line 9—9 of FIG. 8.

FIGS. 8 through 10 of the drawings are similar to FIGS. 5 through 7, but show a conventional broadhead tip 52 employed with an arrowhead assembly according to the present invention. Such a tip as tip 52 also is provided with a threaded extension, designated 54, which may threadingly engage with socket 28. As will be appreciated, virtually any conventional arrowhead tip may be employed with the basic elements of a arrowhead assembly according to the present invention. In fact, the shank, shield, and spring themselves form a novel combination, although they may also be employed in combination with the adapter 40 and sleeve 46, and with a conventional, or specially constructed, tip.

It is also to be understood that the type of tips employed with an assembly according to the present invention are not limited to those tips commonly used in the course of hunting, as the conventional field tip may also be employed, as may any practice tip, and the like.

As will be readily appreciated from the above description and from the drawings, an arrowhead assembly according to the present invention provides a resiliently mounted shield that will permit an animal, and the like, to be shot without the arrow passing through the animal. The effect of having the point left in the body of the animal inflicts much greater damage more quickly to the animal and results in a more humane kill. The shield is also functional, in that it serves as a slowing-up mechanism, so that after an arrow is shot, it will not continue on for further than a predetermined distance. This mechanism also prevents the loss of game under water once a fish, frog, and the like, has been impaled on the point.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An arrow assembly including a shaft having a forward end, an elongated shank having front and rear ends, the rear end of said shank being removably secured to the forward end of said shaft with said shank defining a forward lengthwise projecting extension of said shaft, the rear end portion of said shank including means defining a first outwardly projecting abutment, a shield slidably mounted on said shank for movement therealong forward of said abutment, resilient means on said shank engaged with said abutment and shield yieldingly biasing the latter forwardly along said shank, an arrowhead tip removably mounted on the forward end of said shank and including a rear portion defining a second outwardly projecting abutment establishing a limit stop of movement of said shield forwardly along said shank.

2. The combination of claim 1 wherein said arrowhead tip comprises a broadhead tip.

3. A structure as defined in claim 1 wherein said first abutment comprises a radially outwardly projecting circumferential flange carried by said shank, said resilient means comprising a coiled compression spring arranged on the shank between the flange and the shield.

4. A structure as defined in claim 3, wherein the shield comprises an annular cup constructed from a substantially rigid material and provided with a central opening slidably receiving the shank therethrough.

5. A structure as defined in claim 1, wherein the tip includes a cylindrical blunt head.

6. A structure as defined in claim 1, wherein the tip comprises a fish point provided with at least one barb and including a base portion flared toward the rear end thereof and terminating in a threaded rod, a sleeve having a threaded socket engaging the threaded rod, and an adapter provided with a threaded, shouldered extension threadedly engaged in the front end of the shank, the sleeve being telescoped over and affixed to the adapter with the rear end of said sleeve defining sai second abutment.

7. A structure as defined in claim 1, wherein the shield is an annular cup constructed from a substantially rigid material and provided with a central opening slidably receiving the shank therethrough.

8. An arrowhead assembly, comprising, in combination:

a. am arrowhead tip;

b. a shank having a threaded socket, the shank connectible to a shaft of an arrow and connected to the arrowhead tip;

c. a shield slidably mounted on the shank for movement with respect thereto; and d. resilient means arranged on the shank and abutting the shield for biasing the shield toward the tip and permitting the shield to retard motion of the arrow when penetrating a target, the tip including a cylindrical blunt head and a threaded, shouldered extension engaged with the socket of the shank.

9. An arrowhead assembly, comprising, in combination:

a. an arrowhead tip;

b. a shank having a threaded socket, the shank connectible to a shaft of an arrow and connected to the arrowhead tip;

c. a shield slidably mounted on the shank for movement with respect thereto; and d. resilient means arranged on the shank and abutting the shield for biasing the shield toward the tip and permitting the shield to retard motion of the arrow when penetrating a target, the tip being a fish point provided with at least one barb and including a base portion flared toward an end thereof terminating in a threaded rod, and further including a sleeve having a threaded socket engaging the threaded rod, and an adapter provided with a threaded, shouldered extension engageable with the socket of the shank, the sleeve being arranged over and affixed to the adapter and between and abutting the tip and the shield.

* * * * *